United States Patent [19]

Farb

[11] Patent Number: 4,498,388

[45] Date of Patent: Feb. 12, 1985

[54] PRINT HAMMER MECHANISM HAVING INTERMEDIATE PIVOT FULCRUM

[75] Inventor: Norman E. Farb, Villa Park, Calif.

[73] Assignee: Printronix, Inc., Irvine, Calif.

[21] Appl. No.: 606,650

[22] Filed: May 3, 1984

Related U.S. Application Data

[63] Continuation of Ser. No. 406,035, Aug. 6, 1982, abandoned.

[51] Int. Cl.[3] ..... B41J 3/10

[52] U.S. Cl. ..... 101/93.04; 101/93.29

[58] Field of Search ..... 101/93.02, 93.04, 93.29, 101/93.32, 93.33, 93.48

[56] References Cited

U.S. PATENT DOCUMENTS

| | | | |
|---|---|---|---|
| 3,726,213 | 4/1973 | Herbert | 101/93.02 |
| 3,896,918 | 7/1975 | Schneider | 101/93.05 |
| 4,200,043 | 4/1980 | Nozaki et al. | 101/93.29 |
| 4,233,894 | 11/1980 | Barrus et al. | 101/93.0 X |

*Primary Examiner*—Edgar S. Burr
*Assistant Examiner*—David A. Wiecking
*Attorney, Agent, or Firm*—Fraser and Bogucki

[57] ABSTRACT

In a print hammer mechanism in which a thin, flat hammer spring is mounted at a fixed end thereof to a magnetic structure which includes a permanent magnet and a pole piece having a pole tip facing the opposite free end of the hammer spring on a side of the hammer spring opposite an impact printing tip, a pivot fulcrum is formed by an impact arrangement which faces an intermediate portion of the hammer spring between the fixed and free ends thereof. The permanent magnet normally pulls the hammer spring into a retract position in which the spring impacts and resides against the impact structure with the free end of the spring forming an air gap with the pole tip. Energization of a coil surrounding the pole piece releases the hammer spring from the retract position, enabling the spring to return toward a neutral position and then impact a printable medium such as a print paper-ink ribbon combination, following which the magnetic attraction of the permanent magnet returns the hammer spring to the retract position in which it strikes the impact structure and remains in the retract position pending the next energization of the coil. The location of the impact arrangement is such as to greatly minimize wear at its interface with the hammer spring while at the same time enhancing the release characteristics of the hammer spring.

In a preferred embodiment the impact structure is formed by a secondary pole piece extending in parallel, spaced-apart relation along a portion of the length of the hammer spring from the fixed end thereof and terminating in a pole tip covered with a thin layer of Kapton.

9 Claims, 5 Drawing Figures

PRINT HAMMER MECHANISM HAVING INTERMEDIATE PIVOT FULCRUM

This is a continuation of application Ser. No. 406,035, filed Aug. 6, 1982, now abandoned.

BACKGROUND OF THE INVENTION

1. Field of the Invention

The present invention relates to dot matrix impact line printers, and more particularly to print hammer mechanisms for use therein in which flexible hammer springs normally held in a retract position by a magnetic structure are selectively released to effect impact printing via dot printing impact tips mounted on the free ends of the hammer springs.

2. History of the Prior Art

It is known to provide in a dot matrix line printer a reciprocating shuttle containing a hammer bank in which a plurality of elongated, resilient, generally parallel hammer elements having dot impacting tips at the free ends thereof are selectively released from retracted positions so as to impact an ink ribbon against a platen supported print paper as the shuttle reciprocates relative to the print paper. Such an arrangement is shown in U.S. Pat. No. 3,941,051 of Barrus et al, issued March 2, 1976 and commonly assigned with the present application. In the Barrus et al patent, the hammer bank employs a print hammer mechanism which forms a generally C-shaped magnetic circuit between the opposite fixed and free ends of the hammer elements. The magnetic circuits include a common permanent magnet to which the hammer elements are coupled at their fixed ends, a common magnetic return path coupled to the permanent magnet opposite the hammer elements and a plurality of pole pieces, each of which extends outwardly from the magnetic return path so as to terminate in a pole tip facing the free end of the hammer element. Flux from the permanent magnet normally pulls the hammer element out of a neutral position and into a spring-loaded retract position against the pole piece. Each time a coil surrounding the pole piece is momentarily energized, the attracting force of the permanent magnet is overcome long enough to release the hammer element from the retract position and send it flying in the direction of the ink ribbon and print paper. Following impacting of the dot printing tip against the ribbon and paper, the hammer element rebounds back into the spring-loaded retract position in preparation for the next energization of the coil.

The print hammer mechanism shown in the Barrus et al patent utilizes a single pole piece with each hammer spring. It has been found that the performance of such mechanisms can be improved by adding a second pole piece as shown, for example, by U.S. Pat. No. 4,233,894 of Barrus et al which issued Nov. 18, 1980 and which is also commonly assigned with the present application. In the print hammer mechanisms of U.S. Pat. No. 4,233,894, the hammer spring contacts the primary pole piece and at the same time forms an air gap with a secondary pole piece disposed between the primary pole piece and the fixed end of the hammer spring. The air gap formed by the secondary pole piece and the additional flux path provided by the secondary pole piece combine to improve both the release and retract characteristics of the print hammer mechanism. An alternative arrangement utilizing two different pole pieces with each hammer spring and realizing similar advantages is shown in U.S. Pat. No. 4,258,623 of Barrus et al which issued Mar. 31, 1981 and which is also commonly assigned with the present application.

The print hammer mechanisms shown in the various Barrus et al patents have been found to function reliably and effectively for printer applications utilizing speeds of up to 600 lines per minute and greater. In this connection it has been observed that the wear imposed on print hammer mechanisms increases greatly at the higher printing speeds. Thus, wear which may be insignificant at printing speeds of up to 300 lines per minute may become a significant factor affecting the practical longevity of the print hammer mechanism when printing at 600 lines per minute is consistently required. Experience has shown that a significant amount of wear may occur on both the hammer spring and the primary pole piece tip at high printing speeds due to the frequent impacting of the primary pole piece tip by the free end of the hammer spring each time the hammer spring rebounds from printing a dot into the retract position. In time a crater-shaped recess begins to wear in the free end of the hammer spring, which recess can become as deep as 1.7 mils in places. Eventually, the hammer spring may actually fracture or may become difficult to pull into the retract position after each impact printing due to the increased air gap between the pole piece tip and the hammer spring defined by the crater. The pole piece tip is itself subject to wear. Attempts to minimize the wear by covering the pole piece tip with plastic materials and other elastomers have met with very limited success, apparently due to the rather substantial impact which occurs and the resulting tendency for such materials to wear out rapidly and require frequent replacement, thereby adding to the problem.

In addition to the wear problems which are aggravated by higher printing speeds in the print hammer mechanisms of the type shown in the Barrus et al patents, there are other operating characteristics of such mechanisms which are always subject to improvement. For example, the current required to energize the coil mounted on the primary pole piece so as to release the hammer spring is a significant factor in the overall current requirements of the printer. Any reduction in the current required to effect release of the hammer springs while at the same time achieving satisfactory operating characteristics of the print hammer mechanisms is a welcome improvement. Such a reduction in the current requirement is often accompanied by an improvement in the actual release characteristics of the hammer spring. It has also been observed in instances of high speed printing that portions of the hammer spring other than that which impacts the pole piece can undergo a type of metal corrosion due to abrasion and overall vibration of the mechanism. This has been observed to occur, for example, at the interfaces between the hammer spring and adjoining materials where the spring is mounted at its fixed end. Such metal corrosion also attributes to reduction in spring life.

Accordingly, it would be desirable to provide an improved print hammer mechanism.

It would furthermore be desirable to provide a print hammer mechanism which acts to reduce or minimize wear due to constant impacting of the hammer springs with the pole pieces of the magnetic structure.

It would furthermore be desirable to provide a print hammer mechanism having further potential or advantages in terms of other types of wear and in the actual operating characteristics of the mechanism.

BRIEF DESCRIPTION OF THE INVENTION

The above-stated objects and other objects are accomplished in accordance with the invention by a print hammer mechanism utilizing an intermediate pivot fulcrum. The intermediate pivot fulcrum is provided by an impact structure having a surface disposed in facing relation to the hammer spring at an intermediate portion of the hammer spring between the opposite fixed and free ends. The print hammer mechanism is arranged so that as the hammer spring is down into the retract position, the intermediate portion of the hammer spring impacts and thereafter resides against the impact structure. At the same time the hammer spring forms an air gap with the primary pole piece so as to afford the advantages possible with a contacting pole piece and a separate air gap-forming pole piece.

The impact structure is preferably covered with a member of plastic or similar elastomeric material such as Kapton so as to provide an elastomeric, nonmetallic pivot fulcrum. This feature combines with the location of the area of impact at an intermediate region of the hammer spring to greatly reduce interfacial wear between the hammer spring and the impact structure while at the same time greatly minimizing fatigue fracture of the hammer spring. Vibrations and other energy are readily absorbed and the flexure of the hammer spring is itself such as to minimize metal corrosion of the hammer spring at its mounted fixed end. At the same time, the hammer spring has been found to release more easily using less release current than required in many of the arrangements noted above.

In a preferred embodiment according to the invention, the impact structure is formed by a secondary pole piece mounted with the fixed end of the hammer spring so as to extend in generally parallel, spaced apart relation relative to the spring between the fixed end and the intermediate portion of the spring. The secondary pole piece terminates in a pole tip defining an impact surface for receiving and holding the intermediate portion of the hammer spring. This impact surface is covered with a thin layer of Kapton. A piece of Kapton is mounted at a lower portion of the secondary pole piece so as to extend along the pole piece and then over the impact surface-defining pole tip thereof. While interfacial wear is considerably less than in the case of the print hammer mechanisms noted above, such wear may be even further reduced by placing the secondary pole piece tip or other impact structure at or close to the node of the second order of vibration of the hammer spring in the plane of the spring.

BRIEF DESCRIPTION OF THE DRAWINGS

The foregoing and other objects, features and advantages of the invention will be apparent from the following more particular description of a preferred embodiment of the invention, as illustrated in the accompanying drawings, in which.

DETAILED DESCRIPTION

Figure 1:
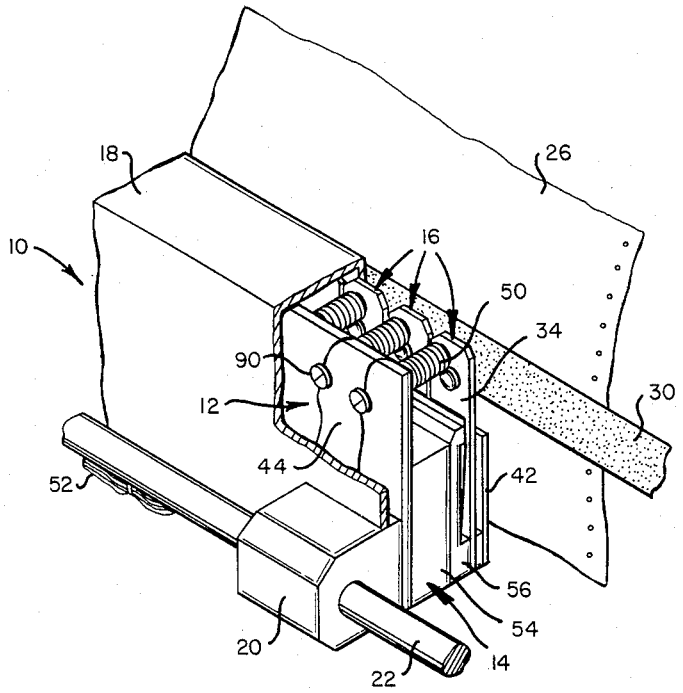
FIG. 1 is a perspective view, partly broken away, of a portion of a shuttle having therein a hammer bank employing print hammer mechanisms in accordance with the invention.

FIG. 1 depicts a shuttle 10 which includes a hammer bank 12 employing print hammer mechanisms 14 in accordance with the invention. Each of the print hammer mechanisms 14 includes a different one of a plurality of hammers 16. The shuttle 10 includes a hollow, generally rectangular cover 18 defining a frame for the shuttle 10. As seen in FIG. 1 a bracket 20 extends through the cover 18 to the outside of the shuttle 10 at one end thereof and receives a support shaft 22 therein. The opposite end of the shuttle 10 is also provided with a bracket and support shaft which are omitted from FIG. 1 for simplicity of illustration but which function in the same manner as the bracket 20 and the support shaft 22 to permit sliding, reciprocating motion of the shuttle 10. At the same time the brackets permit the shuttle 10 to be pivoted outwardly and away from a length of paper 26 which is disposed on the opposite side of an ink ribbon 30 from the hammer bank 12.

The manner in which the shuttle 10 is mounted and driven in reciprocating fashion is identical to the arrangement described in previously referred to U.S. Pat. No. 3,940,051 of Barrus et al. The Barrus et al patent describes in considerable detail the manner in which a double lobed cam drive is used to reciprocate the shuttle relative to a length of paper to effect printing in dot matrix fashion by individual and independent actuation of a plurality of hammers mounted in parallel, side-by-side relation within the shuttle. Each hammer is equipped with a dot matrix printing tip substantially at the center of percussion thereof, which tip impacts an ink ribbon against a platen-supported paper upon energization of a coil to release the hammer from a retract position in which it is normally held by a permanent magnet. Following each horizontal sweep of the shuttle along the paper to print a line of dots, the paper is vertically incremented and the shuttle thereafter undergoes a horizontal sweep in the opposite direction to effect printing of the next line of dots on the paper.

Figure 2:
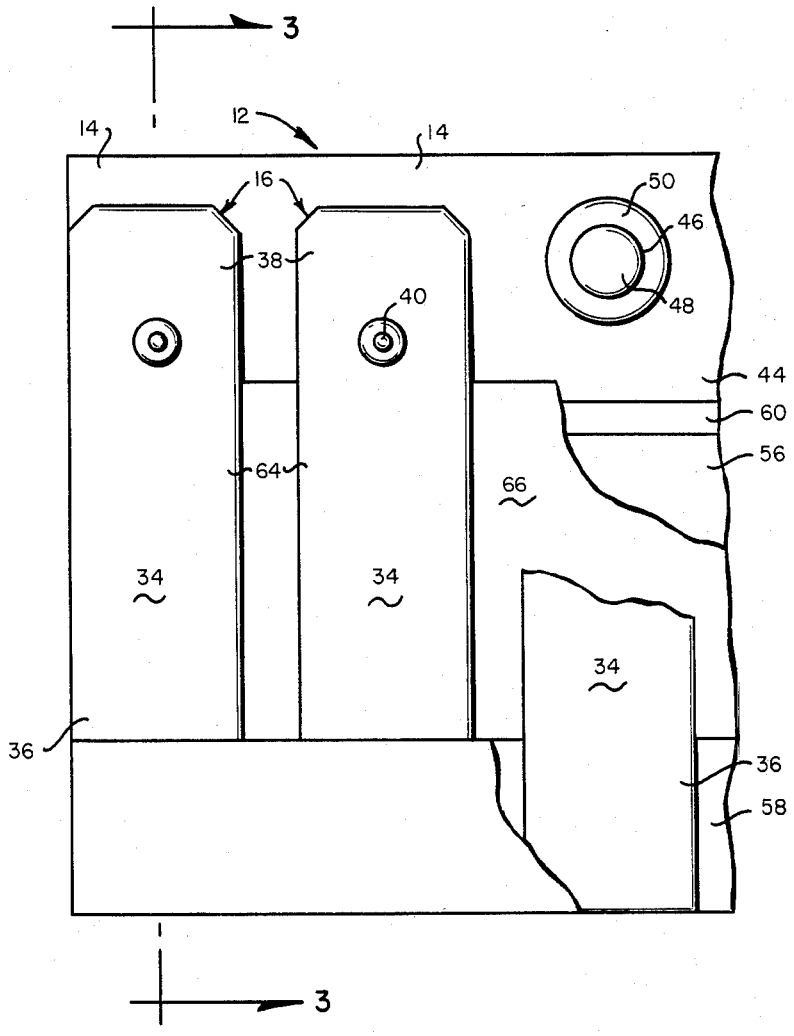
FIG. 2 is a front elevation of a portion of the hammer bank of FIG. 1.

As seen in FIG. 2 as well as in FIG. 1, each of the hammers 16 comprises a relatively thin, generally planar spring 34 of resilient magnetic material mounted at a lower fixed end 36 thereof in spaced-apart relation to the other springs 36 along a generally horizontal axis across the front of the hammer bank 12 and being generally vertically disposed and terminating in an upper movable free end 38 thereof. Each spring 34 includes a dot matrix printing impact tip 40 extending normal from the surface of the spring 34 in the direction toward the ribbon 30. The tips 40 of the successive hammers 16 lie along a selected horizontal line. When retracted, each tip 40 is disposed slightly behind a different aperture in a front face 42 of the cover 18.

As seen in FIGS. 1 and 2, the print hammer mechanisms 14 within the hammer bank 12 include a planar common return member 44 of magnetic material mounted in parallel, spaced apart relation to the hammers 16 on the opposite sides of the hammers 16 from the printing tip 40. Each print hammer mechanism 14 includes a first pole piece 46 of generally cylindrical configuration having a pole tip 48 and extending outwardly from the common return member 44 into close juxtaposition to an associated one of the hammers 16. Each hammer 16 forms an air gap with and is in magnetic circuit with the adjacent magnetic pole piece 46 when in the retract position. Electromagnetic energizing coils 50 are individually wound around each of the pole pieces 46 adjacent the pole tip 48 thereof, with leads from the coils 50 conveniently being joined to terminals and printed circuit conductors (not shown in detail) on the common return member 44. External conductors to associated circuits are physically coupled together in a harness 52 extending outwardly from the shuttle 10 to associated driving circuits. The harness 52 reciprocates along its length with the motion of the shuttle 10.

The print hammer mechanisms 14 also include a common permanent magnet 54 of elongated bar form, disposed between the common return member 44 and a secondary pole piece 56. The secondary pole piece 56 serves as a common mount for each of the hammer springs 34. The secondary pole piece 56 is of thin, planar configuration and extends along a portion of the length of each hammer spring 34 in generally parallel, spaced-apart relation thereto between an outwardly extending first end 58 and an opposite second end which terminates in a pole tip 60. The secondary pole piece 56 has a broad surface 62 on one side thereof disposed in contacting relation with the common permanent magnet 54. The first end 58 extends outwardly from a side of the pole piece 56 opposite the broad surface 62 so as to receive and mount the lower fixed ends 36 of the hammer springs 34 in generally parallel, spaced-apart relation therealong. The end of the pole piece 56 opposite the first end 58 curves outwardly on the opposite side thereof from the broad surface 62 to form the pole tip 60.

Figure 3:
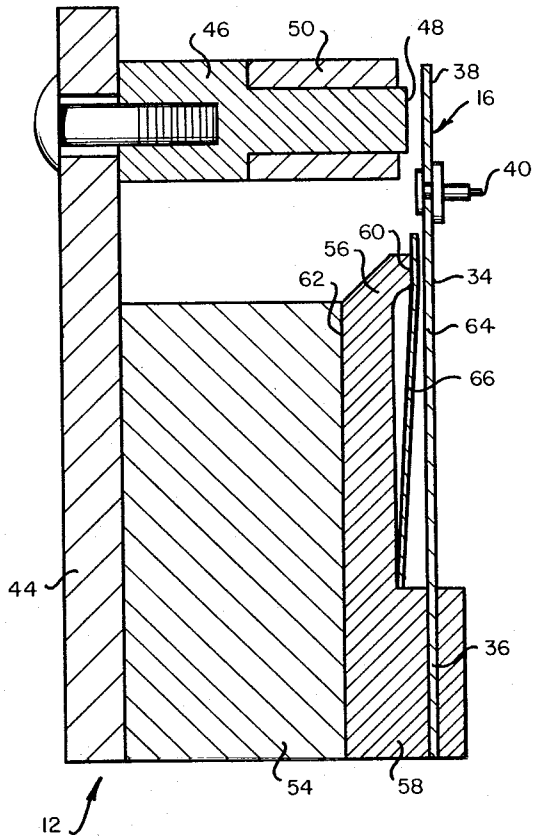
FIG. 3 is a sectional view of the hammer bank of FIG. 1 taken along the line 3—3 of FIG. 2 and showing a hammer spring in a neutral, unflexed position.

FIG. 3 depicts the hammer spring 34 of one of the print hammer mechanisms 12 in the neutral or unflexed position. In this position, an air gap is formed between the pole tip 48 of the first pole piece 46 and the upper free end 38 of the spring 34. An air gap also exists between an intermediate portion 64 of the hammer spring 34 and a thin layer 66 of elastomeric material such as Kapton which extends upwardly from the first end 58 of the secondary pole piece 56 and which covers the pole tip 60. The thin layer 66 comprises a single piece of material extending along the length of the hammer bank 12 so as to cover the pole tip 60 at the intermediate portion 64 of each of the hammer springs 34 along the length of the hammer bank 12. The lower end of the thin layer 66 is secured to the secondary pole piece 56 by adhesive or other appropriate means. In the present example the thin layer 66 of Kapton is approximately 5 mils thick.

Figure 4:
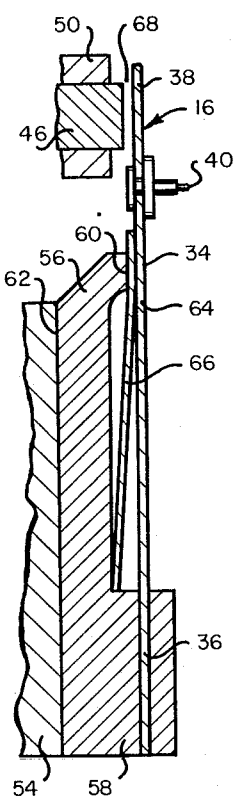
FIG. 4 is a sectional view similar to that of FIG. 3 but showing the hammer spring in the retract position.

When the coil 50 is not energized, the magnetic attraction provided by the permanent magnet 54 at the pole tips 48 and 60 has the effect of pulling the hammer spring 34 into a retract position which is shown in FIG. 4. With the hammer spring 34 in the retract position, the intermediate portion 64 of the spring 34 resides against the portion of the thin layer 66 covering the pole tip 60. At the same time a small air gap 68 of approximately 1–2 mils in size is formed between the upper free end 38 of the hammer spring 34 and the pole tip 48 of the first pole piece 46.

Release of the hammer spring 34 from the retract position shown in FIG. 4 is accomplished by energizing the coil 50 long enough to overcome the effects of the permanent magnet 54. This causes the hammer spring 34 to flex through the neutral, upstanding position shown in FIG. 3 to a position in FIG. 5 in which the tip 40 impacts the ink ribbon 30 against the paper 26 which is supported on the opposite side thereof from the ink ribbon 30 by a platen 70. The hammer spring 34 and its included tip 40 rebound from the ink ribbon 30 and the paper 26 so as to fly through the neutral position shown in FIG. 3 to the retract position shown in FIG. 4. When the hammer spring 34 reaches the retract position, the intermediate portion 64 thereof impacts and then resides against the portion of the thin layer 66 covering the pole tip 60. At the same time the air gap 68 remains between the upper free end 38 of the hammer spring 34 and the pole tip 48 of the first pole piece 46. When the coil 50 is again momentarily energized, the process is again repeated with the hammer spring 34 flying forward through the neutral position of FIG. 3 to the impact position of FIG. 5 with the spring 34 then rebounding back into the retract position of FIG. 4.

Each time the hammer spring 34 returns to the retract position of FIG. 4, the intermediate portion 64 thereof impacts the pole tip 60 through the intervening thin layer 66. The secondary pole piece 56 and the thin layer 66 accordingly form an impact structure in addition to a secondary pole piece. It has been found in accordance with the invention that the interfacial wear between the intermediate portion 64 of the hammer spring 34 and the thin layer 66 and the pole tip 60 is minimal compared to the wear problems encountered with prior art print hammer mechanisms. This is due at least in part to the fact that the pole tip 60 and the adjacent portion of the thin layer 66 form an intermediate pivot fulcrum which is considerably closer to the lower fixed end 36 of the hammer spring 34 than is the pole tip 48 of the first pole piece 46 which is used as the impact surface in certain prior art structures. A further reason for the minimum interfacial wear relates to the nature of the hammer spring 34 itself and the manner in which it flexes and vibrates. When flexed from the neutral position shown in FIG. 3, the hammer spring 34 undergoes a first mode of vibration within the plane thereof at its natural frequency of vibration. At the same time the hammer spring 34 experiences other and higher modes of vibration within the plane thereof. The next higher such mode of vibration which occurs at a frequency considerably greater than the natural frequency of the spring has the effect of causing the hammer spring 34 to undergo a whipping or undulating motion along the length thereof as the spring 34 flexes about its lower fixed end 36. This whipping or undulating motion causes the spring 34 to undergo a generally vertical sliding motion on a surface which it impacts so as to increase the wear at the interface between the hammer spring and the impact surface. The nature of that next higher mode of vibration of the hammer spring 34 is such that this vertical sliding motion is much greater at the upper free end 38 of the hammer spring 54 than at the intermediate portion 64 thereof so that a much greater rubbing action occurs when the point of impact is chosen to be the pole tip 48 of the first pole piece 46. In this connection it has been found that the effects of the next higher mode of vibration on interfacial wear at the point of impact is virtually eliminated if the intermediate fulcrum formed by the pole tip 60 and the adjacent portion of the thin layer 66 are located at the node of the next higher mode of vibration.

Figure 5:
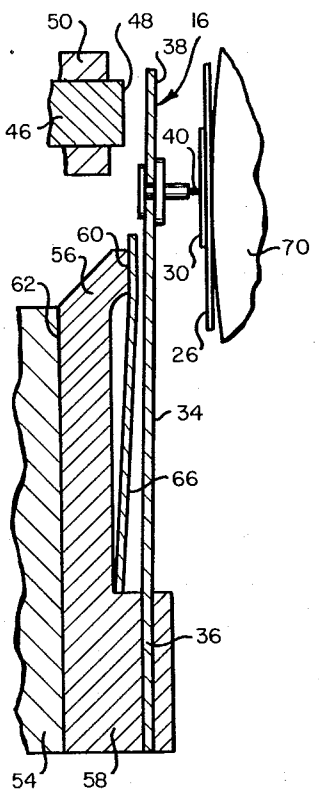
FIG. 5 is a sectional view similar to that of FIG. 3 but showing the hammer spring in its extreme released position.

In the print hammer mechanism 14 shown in FIGS. 3–5, the intermediate pivot fulcrum formed by the pole tip 60 of the secondary pole piece 56 together with the adjacent portion of the thin layer 66 is approximately at the node of the next higher mode of vibration within the plane of the hammer spring 34. This accounts at least in part for the very small amount of interfacial wear which occurs between the intermediate portion 64 of the hammer spring 34 and the thin layer 66 as compared with covering the pole tip 48 of the first pole piece 46 with a thin layer of Kapton or similar elastomeric material and using the pole tip 48 as the point of impact as in the case of some of the prior art print hammer mechanisms. In the print hammer mechanisms shown in U.S. Pat. Nos. 4,233,894 and 4,258,623 which are referred to earlier, the hammer spring impacts and resides against the pole tip of the first or primary pole piece and forms an air gap with the secondary pole piece. It has been found that both the release and the retract characteristics of the hammer spring are enhanced by the use of two such pole pieces with an air gap being maintained at one of the pole pieces when the hammer spring is in the retract position. These advantages are also realized by the print hammer mechanism 14 of the present invention in which the air gap 68 exists between the hammer spring 34 and the first pole piece 46 when the hammer spring 34 is in the retract position as shown in FIG. 4. Additional advantages in the release and retract characteristics of the hammer spring are also realized by creating a pivot fulcrum at an intermediate portion of the hammer spring 34 as provided by the pole tip 60. The magnetic attraction exerted on the upper free end 38 of the hammer spring 34 by the first pole piece 46 through the air gap 68 when the hammer spring 34 is in the retract position of FIG. 4 has the effect of creating a point load on the flexed beam formed by the hammer spring 34. This point loading is different from the nature of the load exerted on the hammer spring 34 when the first pole piece 46 is used as the point of contact and has the effect of releasing the hammer spring 34 from the retract position of FIG. 4 more easily and with the application of less current to the coil 50. Slight reductions in the amount of release current required in the various print hammer mechanisms 14 can become significant in terms of the overall current consumed by the hammer bank 12.

In addition to minimizing interfacial wear between the hammer spring 34 and the impacting surface, the print hammer mechanisms 14 in accordance with the invention have been found to greatly reduce to the point of almost complete elimination fatique fracture of the hammer spring 34. Because the pivot fulcrum provided by the pole tip 60 is located adjacent the intermediate portion 64 of the hammer spring 34, the impact itself is greatly reduced compared with arrangements in which the free upper end 38 of the hammer spring 34 impacts a surface. This factor alone accounts for a considerable decrease in the likelihood of fatique fracture of the hammer spring 34. A further factor in the reduction of hammer fatique fracture, however, relates to the greatly reduced interfacial wear. In prior art printing hammer mechanisms where the constant interfacial wear causes a crater-like depression to occur in the mating surface of the hammer spring, such crater-like depression subjects the hammer spring to a much greater likelihood of fatigue fracture, particularly when the increased impact on the hammer spring is also considered.

A further advantage of print hammer mechanisms 14 in accordance with the invention manifests itself in the form of less abrasion and corrosion of the hammer spring 34 and the interfacing elements within the print hammer mechanism. In many of the prior art print hammer mechanisms metal corrosion is found to occur at the interfaces between the lower fixed end 36 of the hammer spring 34 and adjacent elements such as the outwardly extending first end 58 of the secondary pole piece 56. This corrosion appears to be due to the manner in which the hammer spring 34 flexes and the amount of impact involved. These factors attribute to abrasive motions at the metal interfaces which can cause the actual metal corrosion referred to. In print hammer mechanisms 14 according to the invention such metal corrosion is greatly minimized due to the reduced impact and the different manner in which the hammer spring flexes.

In the present example, the element 66 is described as a single layer of resilient, wear-resistant material such as Kapton. In actual practice other configurations of Kapton or like materials can be used with similar results. For example, the single layer 66 can be replaced by a laminate of layers of Kapton or similar material. In one particular alternative embodiment according to the invention, the layer 66 is replaced by a laminate consisting of a 1 mil thick layer of Kapton extending from the outwardly extending first end 58 of the secondary pole piece 56 over the pole tip 60 and onto the pole tip 48 and two 2 mil thick layers of Kapton extending from the outwardly extending first end 58 of the secondary pole piece 56 over the pole tip 60 to a location short of the pole tip 48 where they terminate. The result is a 5 mil thick element of Kapton at the pole tip 60 as in the case of the thin layer 66. In addition a 1 mil thick layer of Kapton resides over the pole tip to absorb impacting of the pole tip 48 by the hammer spring 34 which can occur under certain conditions such as where the distance between the print hammer mechanism 14 and the platen 70 is made relatively large.

While the invention has been particularly shown and described with reference to a preferred embodiment thereof, it will be understood by those skilled in the art that various changes in form and details may be made therein without departing from the spirit and scope of the invention.

What is claimed is:

1. A print hammer mechanism comprising:

a resilient hammer element having opposite fixed and free ends, the free end of the hammer element having structure mounted thereon consisting of a dot imprinting tip of relatively small size and mass;

a magnetic structure mounting the hammer element at the fixed end of the hammer element;

a pole piece mounted on the magnetic structure and terminating in a pole tip disposed in facing relation to the free end of the hammer element;

a hammer element impact arrangement disposed in facing relation to the hammer element at an intermediate portion of the hammer element between the fixed end and the free end of the hammer element, the impact arrangement having a surface facing the intermediate portion of the hammer element and covered with an elastomeric material;

the hammer element being spaced apart from both the pole tip and the impact arrangement when in a neutral, unflexed position and being of generally planar configuration and being positioned to impact the impact arrangement approximately at the node of the second order of vibration of the hammer element in the plane of the hammer element; and means coupled to the magnetic structure for providing a magnetic field which normally attracts the hammer element toward the pole tip and the impact arrangement, the pole tip and the impact arrangement being disposed so that the hammer element impacts and resides against the impact arrangement and forms an air gap with the pole tip when the hammer element is caused to flex into a retract position by the magnetic field.

2. The invention set for in claim 1, wherein the means for providing a magnetic field includes a permanent magnet within the magnetic structure for normally attracting the hammer element into the retract position and a coil mounted on the pole piece for selectively cancelling the effects of the permanent magnet to release the hammer element from the retract position.

3. The invention set forth in claim 1, wherein the elastomeric material consists of three different layers of elastomeric material.

4. A print hammer mechanism comprising:

a resilient hammer element having opposite fixed and free ends and a center of percussion, the free end of the hammer element having structure mounted thereon consisting of a dot imprinting tip of relatively small size and mass;

a magnetic structure mounting the hammer element at the fixed end of the hammer element;

a pole piece mounted on the magnetic structure and terminating in a pole tip disposed in facing relation to the free end of the hammer element;

a hammer element impact arrangement disposed in facing relation to the hammer element substantially at the center of percussion of the hammer element between the fixed end and the free end of the hammer element;

the hammer element being spaced apart from both the pole tip and the impact arrangement when in a neutral, unflexed position; and means coupled to the magnetic structure for providing a magnetic field which normally attracts the hammer element toward the pole tip and the impact arrangement, the pole tip and the impact arrangement being disposed so that the hammer element impacts and resides against the impact arrangement and forms an air gap with the pole tip when the hammer element is caused to flex into a retract position by the magnetic field;

the impact arrangement comprising a second pole piece mounted on the magnetic structure and terminating in a pole tip disposed in facing relation to the hammer element and being covered with an elastomeric material.

5. The invention set forth in claim 4, wherein the second pole piece is an elongated element which extends in generally parallel, spaced-apart relation to the hammer element between the center of percussion and the fixed end of the hammer element.

6. The invention set forth in claim 5, wherein the elastomeric material comprises a relatively thin, generally planar element of elastomeric material secured to the second pole piece adjacent the fixed end of the hammer element and extending along the second pole piece and over the pole tip thereof.

7. A print hammer mechanism for a dot matrix printer comprising:

a magnetic resilient print hammer element comprising a single elongated, flat strip of resilient material having a generally uniform thickness between opposite broad surfaces and a center of percussion and having a fixed end and an opposite free end having structure mounted thereon consisting of a dot imprinting element extending from one of the broad surfaces of the elongated strip adjacent the free end thereof, the elongated strip being mounted at the fixed end thereof so as to assume a relatively straight configuration defining a neutral position when not flexed;

magnetic circuit means including permanent magnet means and a pair of pole pieces coupled in magnetic circuit with the elongated strip, one of the pair of pole pieces being covered with a layer of elastomeric material and receiving the other one of the broad surfaces of the elongated strip at a region intermediate the fixed end and the oppsite free end of the elongated strip and substantially at the center of percussion of the elongated strip and the other one of the pair of pole pieces forming an air gap with the other one of the broad surfaces of the elongated strip at the free end of the elongated strip when the elongated strip is in a spring-loaded retract position in which the strip is flexed out of the neutral position and assumes a curved configuration, and the permanent magnet means establishing a magnetic field normally maintaining the elongated strip in the spring-loaded retract position; and means coupled to the other one of the pair of pole pieces for substantially cancelling the magnetic field in a portion of the magnetic cicuit means adjacent the elongated strip to release the elongated strip for flight away from the spring-loaded retract position, the resilient material of the elongated strip combining with the magnetic field of the permanent magnet means to return the strip to the spring-loaded retract position following release of the strip and impact of a printable medium by the dot imprinting element.

8. A multiple hammer bank for a print hammer comprising:

a plurality of elongated, flat, substantially parallel, magnetic, spring hammer elements disposed in serial fashion along a selected plane having fixed ends disposed along a selected axis within the selected plane and opposite free ends adjacent a printing line, each of the hammer elements having a center of percussion and each of the free ends having structure mounted thereon consisting of a dot imprinting tip of relatively small size and mass;

magnetic circuit means, including a common magnetic return path member, forming a plurality of substantially complete magnetic paths with said different hammer elements, said magnetic circuit means including a plurality of pairs of magnetic pole pieces, each pair of pole pieces being disposed in facing relation to the free end of a different hammer element with a first one of the pair being disposed on the opposite side of a second one of the pair from the selected axis along which the fixed ends of the spring hammer elements are disposed;

means coupled to said magnetic circuit means for magnetically biasing each of said hammer elements into engagement with the second one of its associated pair of pole pieces and into an air gap forming relation with the first one of its associated pair of pole pieces in the absence of a release impulse, to define a spring-loaded retract position; and means coupled to each of said magnetic circuit means for selectively applying impulses thereto to momentarily overcome the magnetic bias;

the common magnetic return path member having opposite first and second portions thereof extending along the hammer bank and being generally parallel to the selected plane, the means for magnetically biasing said hammer elements comprising a common permanent magnet extending along the hammer bank and coupled to the first portion of the common magnetic return path, the first one of the pair of magnetic pole pieces comprising an elongated element disposed substantially normal to said selected plane and having a first end coupled to the second portion of the common magnetic return path member and an opposite second end terminating in a pole tip disposed in facing relation to the free end of its associated hammer element substantially at the center of percussion of the hammer element and being covered with at least one layer of elastomeric material, and the second one of each pair of magnetic pole pieces comprising a common element disposed such that a relatively flat, generally planar major portion thereof is substantially parallel to said selected plane and having a first end within the major portion disposed between and coupling a fixed end of its associated hammer element opposite the free end thereof to the common permanent magnet and an opposite second end adjacent the major portion terminating in a pole tip disposed in facing relation to the free end of its associated hammer element between the first one of the pole pieces and the fixed end of its associated hammer element.

9. The invention set forth in claim 8, wherein the at least one layer of elastomeric material comprises three layers of Kapton material.

* * * * *